US012385692B2

(12) United States Patent
Thakkar et al.

(10) Patent No.: US 12,385,692 B2
(45) Date of Patent: Aug. 12, 2025

(54) PROCESS AND APPARATUS FOR IMPROVED RECOVERY OF ARGON

(71) Applicant: Air Products and Chemicals, Inc., Allentown, PA (US)

(72) Inventors: Jay A. Thakkar, Allentown, PA (US); Donn Michael Herron, Fogelsville, PA (US); Qiao Zhao, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 316 days.

(21) Appl. No.: 17/968,203

(22) Filed: Oct. 18, 2022

(65) Prior Publication Data

US 2024/0125550 A1 Apr. 18, 2024

(51) Int. Cl.
*F25J 3/00* (2006.01)
*F25J 3/04* (2006.01)

(52) U.S. Cl.
CPC ..... *F25J 3/04684* (2013.01); *F25J 3/048* (2013.01); *F25J 2200/06* (2013.01); *F25J 2200/34* (2013.01); *F25J 2200/40* (2013.01); *F25J 2200/74* (2013.01); *F25J 2270/42* (2013.01); *F25J 2270/50* (2013.01)

(58) Field of Classification Search
CPC .. F25J 3/04096; F25J 3/04654; F25J 3/04684; F25J 3/0466; F25J 3/04678; F25J 2200/34; F25J 2200/40
See application file for complete search history.

(56) References Cited

U.S. PATENT DOCUMENTS

| | | | | |
|---|---|---|---|---|
| 2,688,238 A | | 9/1954 | Shilling | |
| 4,022,030 A | | 5/1977 | Brugerolle | |
| 4,822,935 A | | 4/1989 | Scott | |
| 5,305,611 A | | 4/1994 | Howard | |
| 5,682,764 A | * | 11/1997 | Agrawal | F25J 3/04206 62/646 |
| 5,893,276 A | * | 4/1999 | Higginbotham | F25J 3/04296 62/651 |
| 6,196,024 B1 | | 3/2001 | Ha | |
| 6,397,632 B1 | * | 6/2002 | Meagher | F25J 3/04303 62/648 |
| 6,543,253 B1 | * | 4/2003 | Schaub | F25J 3/04345 62/646 |

(Continued)

FOREIGN PATENT DOCUMENTS

| | | |
|---|---|---|
| DE | 4406069 A1 | 9/1995 |
| EP | 3614082 A1 | 2/2020 |

(Continued)

*Primary Examiner* — Brian M King
(74) *Attorney, Agent, or Firm* — Matthew R. Weaver

(57) ABSTRACT

A process and apparatus for recovering at least argon from a feed gas that can provide an improved recovery of argon as well as an improvement in operational efficiency. Some embodiments can be adapted so that the improved argon recovery can also be obtained with improved condenser operation for an argon column without requiring an increase in power for the recovery of the argon. Some embodiments can utilize a reboiler positioned near or at the bottom of argon recovery column to increase boil-up therein and/or provide added heat duty to drive a condenser of the argon recovery column to provide improved argon recovery.

17 Claims, 5 Drawing Sheets

(56) References Cited

U.S. PATENT DOCUMENTS

| | | | | |
|---|---|---|---|---|
| 11,512,897 | B2 | 11/2022 | Herron et al. | |
| 2007/0283719 | A1* | 12/2007 | Howard | F25J 3/04284 62/646 |
| 2014/0109614 | A1* | 4/2014 | Tachibana | F25J 3/04303 62/643 |
| 2019/0331417 | A1 | 10/2019 | Kromer et al. | |
| 2019/0331418 | A1 | 10/2019 | Prosser et al. | |
| 2019/0331419 | A1 | 10/2019 | Handley et al. | |
| 2022/0221221 | A1 | 7/2022 | Herron et al. | |
| 2024/0035740 | A1* | 2/2024 | Prosser | F25J 3/04709 |

FOREIGN PATENT DOCUMENTS

| | | | |
|---|---|---|---|
| FR | 2839548 | A1 | 11/2003 |
| JP | H07318241 | A | 12/1995 |
| JP | 2414947 | A2 | 6/2003 |
| WO | 14099848 | A2 | 6/2014 |
| WO | 2020244801 | A1 | 12/2020 |
| WO | 2021078405 | A1 | 4/2021 |

* cited by examiner

PROCESS AND APPARATUS FOR IMPROVED RECOVERY OF ARGON

FIELD OF THE INVENTION

The present innovation relates to processes utilized to recover fluids from air that can include an argon column for recovery of argon that can be configured to utilize a reboiler for cooling crude liquid oxygen. The present innovation also relates to air separation units for separation of at least argon from air or other feed gas, gas separation plants configured to recover at least nitrogen or oxygen, and argon from at least one feed gas, air separation plants, air separation systems, systems utilizing multiple columns to recover nitrogen, argon, and oxygen fluids, and methods of making and using the same.

BACKGROUND OF THE INVENTION

Air separation processing has been utilized to separate air into different constituent flows of fluid (e.g. nitrogen, oxygen, etc.). Examples of systems that were developed in conjunction with air separation processing include U.S. Pat. Nos. 4,022,030, 4,822,395, International Patent Publication Nos. WO2020/169257, WO2020/244801, WO 2021/078405 and U.S. Pat. App. Pub. Nos. 2019/0331417, 2019/0331418, and 2019/0331419.

Some manufacturers may require the air separation plant in their facility to supply high purity argon as well as nitrogen. Some examples of argon stream processing can be appreciated from U.S. Pat. No. 5,305,611, International Patent Publication No. 2014/099848, French Patent Publication No. FR 2839548, and Japanese Patent No. JP 3414947.

SUMMARY

We have determined that some air separation processes designed to provide high-purity argon fluid for use by a manufacturing facility or other type of facility that may utilize or produce such argon can incur substantial cost in terms of power needed for processing to obtain incremental recovery of argon from air. We have determined that an improved process can be provided that can increase argon recovery without significantly increasing power needed for operation of the system. For example, some embodiments can utilize a reboiler driven by crude liquid oxygen (CLOX) at or adjacent the bottom of an argon column to provide improved argon recovery by increasing boil-up in the argon column while also simultaneously providing added heat duty benefit to drive the condenser of an argon column. Other embodiments can provide improved operational efficiency by providing more condenser duty for improved recovery of argon while also not increasing power for improvement in argon recovery or not substantively increasing power for the improvement in argon recovery (e.g. providing an increase in heat input for operation of the reboiler that cools the CLOX that can be offset by an increase in heat removal/rejection for operation of the condenser resulting in the improved argon recovery). Embodiments can be employed relatively simply and, in many cases, with relatively small changes to pre-existing process flows for pre-existing plants to permit pre-existing conventional systems to be retrofit to an embodiment of this new process and/or apparatus so that improved argon recovery can be obtained without large capital costs or requiring a new plant to be built.

In a first aspect, a process for separation of a feed gas comprising oxygen, nitrogen, and argon can include compressing the feed gas via a compression system of a separation system having a first column and a second column. The first column can be a high pressure (HP) column operating at a pressure that is higher than the second column. The second column can be a low pressure (LP) column operating at a pressure that is lower than the first column. The process can also include feeding the compressed feed gas to a first heat exchanger to cool the compressed feed gas, feeding at least a first portion of the compressed and cooled feed gas to the HP column to produce an HP oxygen-enriched stream, passing the HP oxygen-enriched stream output from the HP column through a reboiler positioned adjacent to an argon enrichment column or within an argon enrichment column to cool the HP oxygen-enriched stream, and passing at least a portion of the HP oxygen-enriched stream output from the reboiler to a reboiler-condenser of the argon enrichment column for condensing at least a portion of an argon-enriched vapor output from the argon enrichment column that is fed to the reboiler-condenser.

In some implementations, the reboiler positioned adjacent to the argon enrichment column can be within a lower portion or bottom portion of the argon enrichment column. In other implementations, the reboiler can be positioned to cool the HP oxygen-enriched stream via a feed stream fed to the argon enrichment column or via an argon depleted fluid output from the argon enrichment column.

In a second aspect, the process can be configured so that the passing of the HP oxygen-enriched stream output from the HP column through the reboiler positioned adjacent to the argon enrichment column or within the argon enrichment column to cool the HP oxygen-enriched stream includes passing the HP oxygen-enriched stream to the reboiler. The reboiler can be positioned in a bottom of the argon enrichment column or within a lower portion of the argon enrichment column.

In a third aspect, the passing of the HP oxygen-enriched stream output from the HP column through the reboiler positioned adjacent to the argon enrichment column or within the argon enrichment column to cool the HP oxygen-enriched stream can include passing the HP oxygen-enriched stream to the reboiler. The reboiler can be positioned adjacent the argon enrichment column. The process can also include passing an argon depleted fluid stream output from the argon enrichment column to the reboiler so that the HP oxygen-enriched stream is cooled via heat transfer with the argon depleted fluid stream.

In a fourth aspect, the passing of the HP oxygen-enriched stream output from the HP column through the reboiler positioned adjacent to the argon enrichment column or within the argon enrichment column to cool the HP oxygen-enriched stream can include passing the HP oxygen-enriched stream to the reboiler where the reboiler is positioned adjacent the argon enrichment column. An LP argon-enriched stream output from the LP column can also be passed to the reboiler so that the HP oxygen-enriched stream is cooled via heat transfer with the LP argon-enriched stream.

In a fifth aspect, the passing of at least a portion of the HP oxygen-enriched stream output from the reboiler to the reboiler-condenser of the argon enrichment column for condensing at least a portion of the argon-enriched vapor output from the argon enrichment column that is fed to the reboiler-condenser can include splitting the HP oxygen-enriched stream output from the reboiler to form a first oxygen-enriched stream to feed to the LP column and a second oxygen-enriched stream to feed to the reboiler-condenser of the argon enrichment column. The process can also include feeding the second oxygen-enriched stream to the reboiler-condenser of the argon enrichment column and feeding the first oxygen-enriched stream to the LP column.

In a sixth aspect, the passing of at least a portion of the HP oxygen-enriched stream output from the reboiler to the reboiler-condenser of the argon enrichment column for condensing at least a portion of the argon-enriched vapor output from the argon enrichment column that is fed to the reboiler-condenser can include passing an entirety of the HP oxygen-enriched stream output from the reboiler to the reboiler-condenser of the argon enrichment column. The process can also include passing or feeding the portion of the argon-enriched vapor output from the argon enrichment column the reboiler-condenser of the argon enrichment column. The portion of the argon-enriched vapor fed to the reboiler-condenser of the argon enrichment column can be an entirety of the argon-enriched vapor stream output from the argon enrichment column or can be a first portion of that stream. A second portion of that stream can be split from the first portion for being utilized in another element.

In a seventh aspect, the process can also include the HP column outputting a second column reflux stream to feed the second column reflux stream to the LP column.

In an eight aspect, a separation system is provided. The separation system can be configured to utilize any of the above noted aspects of the process for separation of a feed gas comprising oxygen, nitrogen, and argon.

In some embodiments, the separation system can include a first column and a second column. The first column can be a high pressure (HP) column operating at a pressure that is higher than the second column and the second column can be a low pressure (LP) column operating at a pressure that is lower than the first column. The HP column can be connected to the LP column. The system can also include an argon enrichment column and a reboiler positioned adjacent to the argon enrichment column or within a lower portion of the argon enrichment column. The HP column can be connected to the reboiler so that an HP oxygen-enriched stream output from the HP column is feedable to the reboiler for cooling of the HP oxygen-enriched stream. The reboiler can be connected to a reboiler-condenser of the argon enrichment column so that at least a portion of the HP oxygen-enriched stream output from the reboiler is feedable to the reboiler-condenser for condensing at least a portion of an argon-enriched vapor output from the argon enrichment column that is feedable to the reboiler-condenser.

In a ninth aspect, the system can be configured so that the reboiler is positioned in a bottom of the argon enrichment column.

In a tenth aspect, the reboiler can be positioned to receive an argon depleted fluid stream output from the argon enrichment column so that the HP oxygen-enriched stream is coolable via heat transfer with the argon depleted fluid stream.

In an eleventh aspect, the separation system can be configured so that the reboiler is positioned to receive an LP argon-enriched stream output from the LP column so that the HP oxygen-enriched stream is coolable via heat transfer with the LP argon-enriched stream.

In a twelfth aspect, the separation system can be arranged and configured so that the HP column is connected to the LP column such that a second column reflux stream outputtable from the HP column is feedable to the second column reflux stream to the LP column.

In a thirteenth aspect, the reboiler can be connected to the reboiler-condenser of the argon enrichment column and the LP column such that the HP oxygen-enriched stream outputtable from the reboiler is splittable into a first oxygen-enriched stream to feed to the LP column and a second oxygen-enriched stream to feed to the reboiler-condenser of the argon enrichment column.

In a fourteenth aspect, the separation system can be configured and arranged so that the reboiler is connected to the reboiler-condenser of the argon enrichment column such than an entirety of the HP oxygen-enriched stream outputtable from the reboiler is feedable to the reboiler-condenser of the argon enrichment column.

In a fifteenth aspect, a method of retrofitting an air separation unit can be provided. The retrofitting can be provided to facilitate formation or utilization of an embodiment of the separation system or an embodiment of the process for process for separation of a feed gas comprising oxygen, nitrogen, and argon. Embodiments of the method of retrofitting an air separation unit can include positioning a reboiler adjacent to or within an argon enrichment column so that a high pressure (HP) oxygen-enriched stream output from an HP column is feedable to the reboiler to cool the HP oxygen-enriched stream. The method can also include connecting the reboiler to a reboiler-condenser of the argon enrichment column so that at least a portion of the HP oxygen enriched stream output from the reboiler is feedable to the reboiler-condenser for condensing at least a portion of an argon-enriched vapor outputtable from the argon enrichment column that is feedable to the reboiler-condenser.

In a sixteenth aspect, the retrofitting method can be implemented so that the reboiler is positioned in a bottom of the argon enrichment column or within a lower portion of the argon enrichment column.

In a seventeenth aspect, the retrofitting method can be implemented so that the reboiler is positioned adjacent to the argon enrichment column so that an argon depleted fluid stream output from the argon enrichment column is feedable to the reboiler so that the HP oxygen-enriched stream feedable to the reboiler is coolable via heat transfer with the argon depleted fluid stream.

In an eighteenth aspect, the retrofitting method can be implemented so that the reboiler is positioned adjacent to the argon enrichment column so that a low pressure (LP) argon-enriched stream output from a second column is feedable to the reboiler so that the HP oxygen-enriched stream is coolable via heat transfer with the LP argon-enriched stream.

In a nineteenth aspect of the retrofitting method, the positioning of the reboiler adjacent to or within an argon enrichment column can include adjusting conduits to accommodate the use of the reboiler. Other types of adjustments or modifications to an air separation system configuration can also be implemented to facilitate the retrofitting method.

In a twentieth aspect, embodiments of the process for separation of a feed gas, the separation system, or the retrofitting method can be adapted for separation systems that can be arranged and configured as shown in the exemplary embodiments of FIGS. 1-4 or as discussed in the text of the below detailed description section.

It should be appreciated that different streams of fluid that can be utilized in the above discussed embodiments can include vapor, liquid, or a combination of vapor and liquid. Fluid streams that include vapor can include vapor, or gas.

It should also be appreciated that embodiments of the process and/or the system can use a series of conduits for interconnection of different units so that different streams can be conveyed between different units. Such conduits can include piping, valves, and other conduit elements. The system can also utilize sensors, detectors, and at least one controller to monitor operation of the system and/or provide automated or at least partially automated control of the system. Various different sensors (e.g. temperature sensors, pressure sensors, flow sensors, level controllers, etc.) can be connected to different conduits or system elements.

Other elements can also be included in embodiments of the system that may be provided to utilize an embodiment of our process. For instance, one or more pumps, compressors, fans, vessels, pre-treatment units, heat exchangers, expanders, adsorbers, or other units can also be utilized in embodiments of the system. It should be appreciated that embodiments of the system or apparatus can be structured and configured to utilize at least one embodiment of the process.

Other details, objects, and advantages of our processes utilized to recover at least one fluid (e.g. argon, argon and nitrogen, argon, nitrogen, and oxygen, etc.) from air, gas separation plants configured to recover argon from at least one feed gas, air separation plants, air separation systems, systems utilizing multiple columns to recover argon and also optionally nitrogen and/or oxygen fluids, plants utilizing such systems or processes, and methods of making and using the same will become apparent as the following description of certain exemplary embodiments thereof proceeds.

Figure 1:
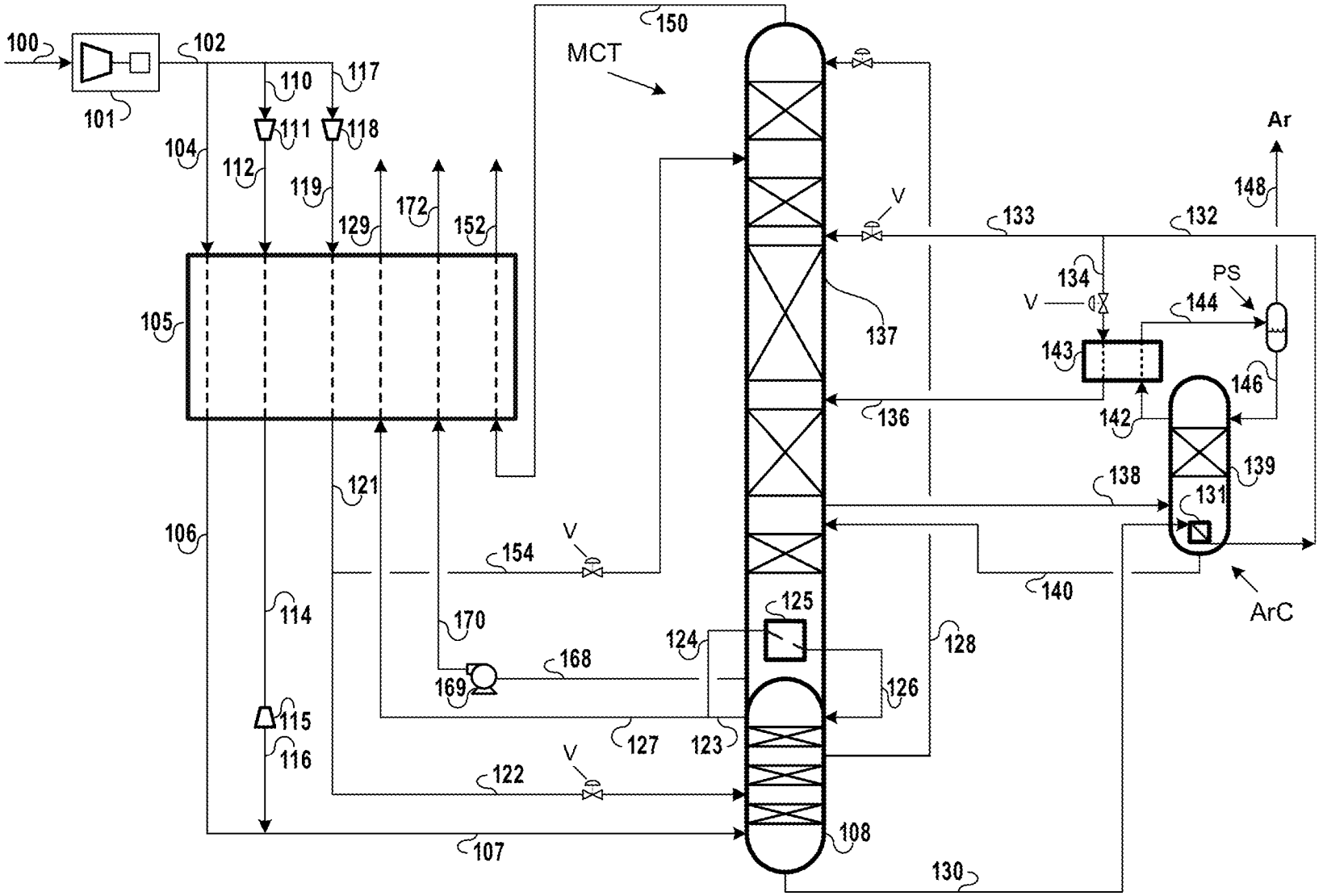
Referring to FIGS. 1-5, a plant can include an air separation unit that includes a compression system 101 that can compress a feed gas 100 to output a compressed feed gas stream 102 at a pre-selected feed pressure or at a pressure within a pre-selected feed pressure range. The feed gas 100 that is compressed can be air or a gas stream from a plant process unit that can be fed to the compression system 101. The feed gas that is compressed by the compression system can include argon (Ar), nitrogen (N2) and oxygen (O2), as well as other constituents (e.g. carbon dioxide (CO2), water (H2O), etc.).

The compression system 101 can also include a purification unit for purification of the feed after it is compressed. The purification unit can remove undesired feed constituents that may have undesired boiling points or present other undesired processing difficulties. The purification unit can remove, for example, CO2, carbon monoxide (CO), hydrogen (H2), methane (CH4) and/or water (H2O) from the feed, for example.

The compressed feed gas stream 102 output from the compression system 101 can be a purified feed gas stream that has impurities removed from the feed gas so that the impurities are below pre-selected constituent thresholds or are entirely removed from the compressed feed gas before the compressed feed gas stream 102 is passed to a first heat exchanger 105. In some embodiments, the compressed feed gas stream 102 can include nitrogen (N2) within a pre-selected nitrogen concentration range, argon (Ar) within a pre-selected argon concentration range, and O2 within a pre-selected oxygen concentration range. The pre-selected N2 concentration range can be, for example, 75-80 volume percent (vol %) of the feed gas stream 102, the pre-selected argon concentration range can be 0.7-3.1 vol % of the feed gas stream 102, and the pre-selected O2 concentration range can be 19-23 vol % of the feed gas stream 102, example.

The compressed feed gas stream 102 can be fed to the first heat exchanger 105 via at least one heat exchanger feed conduit positioned between the compression system 101 and the first heat exchanger 105. As shown in FIGS. 1-4, the feed gas stream 102 can be split into multiple streams before it is fed to the first heat exchanger 105. At least one valve or other splitting mechanism can be utilized to split the compressed feed gas stream 102 into multiple streams, for example. The multiple streams that are formed can include a first feed stream portion 104, a second feed stream portion 110, and a third feed stream portion 117 for feeding to the first heat exchanger 105.

Alternatively, the feed gas stream 102 can be fed to the first heat exchanger 105 as a single stream. In yet other embodiments, the feed gas stream may only be split into two feed streams instead of three feed streams or more than two feed streams.

In embodiments where the compressed feed gas stream 102 is split or is splittable, the first feed stream portion 104 can be between 30% and 100% of the entire compressed feed gas stream 102 and the second feed stream portion 110 can be up to 70% of the entire compressed feed gas stream 102 (e.g. greater than 0% to 70% of the feed stream 102). A third feed stream portion 117 can be up to 50% of the entire compressed feed gas stream 102 (e.g. greater than 0% to 50% of feed stream 102).

The first heat exchanger 105 can cool the one or more feed gas streams to output the one or more compressed feed gas streams at temperatures within pre-selected temperature ranges for the one or cooled more feed streams. For instance, as can be appreciated from FIGS. 1-4, the compressed feed gas stream 102 can be split into a first feed stream portion 104, a second feed stream portion 110 and a third feed stream portion 117. The first feed stream portion 104 can undergo cooling in the first heat exchanger 105 and be subsequently output as a first cooled compressed feed stream 106 for being fed to a first column 108 of a multiple column tower MCT that is upstream of a second column 137 of the multiple column tower MCT.

The second feed stream portion 110 can be fed to a second feed stream compressor 111 to increase its pressure to form a further compressed second feed stream 112 that is subsequently fed to the first heat exchanger 105 to undergo cooling therein. The cooled further compressed second feed stream 114 output from the first heat exchanger 105 can be fed to a first expander 115 so that the second feed stream 116 output from the first expander 115 can be mixed with the first cooled compressed feed stream 106 to form a first column feed stream 107 for feeding that feed stream to the first column 108 of the multiple column tower MCT.

The first column 108 can be a high pressure (HP) column 108 of the multiple column tower MCT that is positioned below or otherwise upstream of the second column 137. The second column 137 can be a low pressure (LP) column of the multiple column tower MCT that can operate at a pressure that is lower than the operational pressure of the HP column 108.

The third feed stream portion 117 can also be compressed via a third feed stream compressor 118 to increase its pressure to form a further compressed third feed stream 119 that is subsequently fed to the first heat exchanger 105 to undergo cooling therein. The cooled further compressed third feed stream 119 can be output from the first heat exchanger 105 as a substantially liquefied third feed stream 121 (e.g. third feed stream 121 is entirely liquid, is between 60 vol % to 100 vol % liquid, is mostly liquid with some vapor mixed therein, is sufficiently liquefied so that the stream has properties of a liquid. etc.). The third feed stream 121 output from the first heat exchanger 105 can be fed to the first column 108 as a second first column feed stream 122 or can be fed to the second column 137 as a second column feed stream 154. In situations where the second first column feed stream 122 is fed to the first column 108, the first column feed stream 107 can be considered a first first column feed stream 107.

In some embodiments or operational cycles utilized during operation of an embodiment, the third feed stream 121 can be split to form the second first column feed stream 122 for feeding to the first column 108 as well as the first second column feed stream 154 for feeding to the second column 137. At least one valve V positioned in the second first column feed stream conduit extending between the first heat exchanger 105 and the first column 108 and at least one valve V positioned in the first second column feed stream conduit extending between the first heat exchanger 105 and the second column 137 can be adjusted to control the splitting of the third feed stream 121. The valves V can also (or alternatively) be controlled to adjust the flow of the third feed stream 121 from the entirety of this stream being fed as the second first column feed stream 122 to the first column 108 to an entirety of the third feed stream 121 being fed as the first second column feed stream 154 for feeding to the second column 137 and vice versa.

In some embodiments, the first column feed stream 107 can be provided so it is at an HP column feeding pressure within a pre-selected HP column feeding pressure range (e.g. 4-30 atm, greater than 5 atm and less than 20 atm, etc.) for feeding the first column feed stream 107 to the first column 108. The cooling via heat exchanger 105 and optional expansion of the second cooled compressed feed stream 114 can be performed so that the first column feed stream 107 is also at a pre-selected HP column feeding temperature that is within a pre-selected HP column feeding temperature range as well as being at a pressure that is within a pre-selected HP column feeding pressure range.

The third feed stream 121 can be formed and compressed to be at the HP feeding pressure within a pre-selected HP feeding pressure range (e.g. 4-100 atm, greater than 5 atm and less than 85 atm, etc.) and also at the a pre-selected HP column feeding temperature that is within a pre-selected HP column feeding temperature range for being fed to the first column 108 as the second first column feed stream 122. The third stream 121 can also, or alternatively, be further compressed and cooled via the heat exchanger 105 and third stream compressor 118 to be at a pre-selected feeding pressure range (e.g. 4-100 atm) so as to substantially condense and also at a pre-selected LP column feeding temperature that is within a pre-selected LP column feeding temperature range for being fed to the second column 137 as the first second column feed stream 154 for feeding to the second column 137. Splitting of the initial compressed feed stream 102 and compression of the third feed stream portion 117 can be performed to facilitate providing the third feed stream 121 at the desired temperature and pressure for substantially condensing the fluid of that stream and feeding it to the first column 108, second column 137, or being split for feeding different portions to each column based on the operational cycle of operation and particular parameter needs for operation in that cycle of operation.

The first second column feed stream conduit can include a pressure reduction mechanism (e.g. a valve) to lower the pressure of the portion of the third feed stream 121 that may be split to feed to the second column 137 so that the pressure of that portion of the stream is within a pre-selected LP pressure range for feeding to the second column 137. It should also be appreciated that in a situation where the entirety of the third stream 121 is to be fed to the second column 137, the third feed stream compressor 118 may not be utilized to further increase the pressure of the third feed stream portion 117.

The first column 108 can be positioned and configured to process the first column feed stream 107 as well as the as the second first column feed stream 122 that can also be fed to the first column 108. As discussed above, in some embodiments or some operational cycles, the first column 108 may only process the first column feed stream 107 (e.g. when the third stream 121 is fed in its entirety to the second column 137 as the first second column feed stream 154). In such situations, the first column feed stream 107 may be the only feed stream fed to the first column 108.

The first column 108 can receive the first column feed stream 107 at or adjacent the bottom of the first column 108. The first column 108 can also receive the second first column feed stream 122 (when provided) at or adjacent the bottom of the first column 108 or at a position that is several stages above the bottom of the first column 108. The first column 108 can operate a pre-selected HP pressure within a pre-selected HP pressure range (e.g. 4.0 atm to 30 atm, 4.5 atm to 16 atm, 4.5 atm to 8 atm, etc.) and can output a HP nitrogen-rich vapor stream 123, a first HP nitrogen-enriched LP feed stream 128 and an HP oxygen-enriched stream 130.

The HP oxygen-enriched stream 130 can be considered a crude liquid oxygen (CLOX) stream that can include liquid oxygen (02) or a combination of liquid O2 and vapor O2. The HP oxygen-enriched stream 130 can have an oxygen concentration in a range of 25 vol % to 50 vol %, an argon concentration of 0.5 vol % to 3.5 vol %, and a nitrogen concentration in the range of 46.5 vol % to 74.5 vol % or the HP oxygen-enriched stream 130 can include 30 vol % oxygen to 50 vol % oxygen, 1 vol % argon to 3 vol % argon, and have the balance be nitrogen (e.g. 47 vol % nitrogen to 69 vol % nitrogen).

The first HP nitrogen-enriched LP feed stream 128 can have an oxygen concentration in a range of 0 vol % to 10 vol %, an argon concentration of 0 vol % to 3.5 vol %, and balance nitrogen (e.g. nitrogen in 100 vol % to 86.5 vol %) or the first HP nitrogen-enriched stream 128 can include 0 vol % oxygen to 5 vol % oxygen, 1 ppm argon to 3 vol % argon, and have the balance be nitrogen (e.g. be about 100 vol % nitrogen to 92 vol % nitrogen).

The HP nitrogen-rich vapor stream 123 can be a stream that includes gas or vapor that has a nitrogen concentration in the range of 100 vol % nitrogen to 98 vol % nitrogen (e.g. 99 vol % nitrogen, 99.5 vol % nitrogen, etc.). At least a portion of the HP nitrogen-rich vapor stream 123 (e.g. an entirety of the stream or a portion of the stream that is a substantial portion of the stream, etc.) can be fed to a first reboiler-condenser 125 as a first reboiler-condenser feed 124 that is split from the HP nitrogen-rich vapor stream 123. A remaining portion of the HP nitrogen-rich vapor stream 123 can be fed to the first heat exchanger 105 as a nitrogen-rich cooling medium stream 127 to undergo warming in the first heat exchanger 105 and cool the portions of the feed stream 102 fed to the first heat exchanger 105. The warmed HP nitrogen-rich vapor stream can be output from the first heat exchanger as a first HP nitrogen-rich vapor product stream 129. This stream can be fed to a plant process that may use the nitrogen stream.

The first reboiler-condenser 125 can be an HP reboiler-condenser 125. The first reboiler-condenser 125 can form an HP condensate stream 126. The HP condensate stream 126 (e.g. an entirety of this stream or less than an entirety of this stream) can be recycled back to the first column 108 as reflux. For instance, at least a portion of the HP condensate stream 126 can be output from the first reboiler-condenser 125 back to the first column 108 as a reflux stream. An entirety of the stream can be provided to the first column or a first portion of this HP condensate stream 126 can be provided back to the first column 108 and a second portion of the HP condensate stream 126 (not shown) can be a HP condensate stream that is feedable to another plant unit.

The first column 108 can be connected to the second column 137 via an LP column feed conduit through which the first HP nitrogen-enriched LP feed stream 128 can be fed to the second column 137. The LP column feed conduit through which the first HP nitrogen-enriched LP feed stream 128 is passed can include a pressure reduction mechanism (e.g. a valve, an expander, other type of pressure reduction mechanism, etc.) to adjust a pressure of the first HP nitrogen-enriched LP feed stream 128 so it is at a suitable pressure for feeding to the second column 137.

The second column 137 can be the LP column of the multiple column tower MCT. The second column 137 can operate at a pressure that is below the pressure at which the first column 108 operates. For example, the second column 137 can operate at a pressure of between 1.1 atm and 4 atm, 1.1 atm and 3 atm, or 1.1 and 2.8 atm.

Reflux for the second column 137 can be provided at a top of the LP column, adjacent the top of the LP column 137, or at another position of the LP column via a suitable reflux stream that includes a suitable concentration of nitrogen. The reflux can include, for example, the first HP nitrogen-enriched LP feed stream 128.

The second column 137 can be positioned so that rising vapor or column boil-up for the second column 137 is provided by the first reboiler-condenser 125. Such rising vapor or boil-up can be generated by the first reboiler-condenser 125 and fed to the second column 137 so that this vapor or boil-up flows in counter-current flow with the liquid fed to the second column 137 (e.g. the fluid of the first HP nitrogen-enriched LP feed stream 128 can be liquid that flows downwardly while the vapor or boil-up flows upwardly in the second column 137, etc.).

The second column 137 can be operated to output multiple flows of fluid during operation. For example, the second column 137 can output at least an LP nitrogen-enriched stream 150, an oxygen-rich stream 168, and an LP argon-enriched stream 138. These streams can each be output from the second column 137 via conduits for feeding those streams to other plant units. The LP nitrogen-enriched stream 150 can be a nitrogen-enriched vapor stream that includes nitrogen in a concentration range of 50 vol % to 70 vol %, a range of 70 vol % to 99.9 vol % nitrogen, or may be entirely nitrogen (e.g. 100 vol % nitrogen or about 100 vol % nitrogen). The LP nitrogen-enriched stream 150 can be output from the second column 137 and fed to the first heat exchanger for cooling therein to form product stream 152, which can be a nitrogen-rich or nitrogen-enriched product stream.

The oxygen-rich stream 168 can be an impurities containing stream that includes enriched, but relatively low, concentrations of xenon, krypton, CO2, methane, and other hydrocarbons with the balance of the stream being oxygen (e.g. 99-99.99 vol % oxygen, or at least 97 vol % oxygen to 99.99 vol % oxygen). The concentration of the trace impurities within the oxygen-rich stream 168 can be highly variable and can depend on a number of factors including the quantity of the flow. In some embodiments, the oxygen-rich stream 168 can include 0.01 vol % to 3 vol % argon, trace amounts of nitrogen, and the balance oxygen (e.g. 97-99.99 vol % oxygen) and be considered an oxygen-rich or oxygen-enriched product stream.

The oxygen-rich stream 168 can be fed to a pump 169 so a compressed oxygen-rich stream 170 can be fed to the first heat exchanger 105 as a cooling medium therein so that it can be warmed therein while cooling the feed stream 102. The warmed oxygen-rich stream can be output from the first heat exchanger 105 as an oxygen-enriched product stream 172 or oxygen-rich product stream 172 for subsequent use by another plant process (use as a regeneration gas, directed to another type of device for producing a krypton-enriched product stream and/or a xenon-enriched product stream, etc.). Alternatively, the compressed and warmed oxygen-rich stream can be considered a waste stream and can be output from the heat exchanger 105 as an oxygen-enriched or oxygen-rich waste stream 172 that can be emitted to the atmosphere. In situations where the oxygen-rich stream 168 is to be considered a waste stream or the oxygen-rich stream 168 does not need to undergo an increase in pressure for further use of that stream, the pump 169 may not be utilized to increase the pressure of the stream before it is fed to the first heat exchange 105.

The LP nitrogen-enriched stream 150 can be output from the second column 137 and fed to the first heat exchanger 105 for functioning as a cooling medium therein to help cool the compressed feed gas fed therein. The warmed LP nitrogen-enriched stream 152 can be output from the first heat exchanger 105 for being emitted as waste gas to atmosphere or used in another plant unit (e.g. used as a product gas, regeneration gas, fed to another plant unit or other use, etc.).

The LP argon-enriched stream 138 can include 5 vol % to 25 vol % argon, 0 to 1000 ppm nitrogen, and the balance oxygen (about 74.9 vol % oxygen to 95 vol % oxygen). The LP argon-enriched stream 138 can be a flow of fluid that includes vapor. The LP argon-enriched stream 138 can be output from the second column 137 and fed to a third column 139. The third column 139 can be considered an argon enrichment column ArC. The argon enrichment column ArC can also be considered an argon column.

An LP argon-enriched feed conduit can be connected between the second column 137 and the argon enrichment column ArC for feeding the LP argon-enriched stream 138 to the argon enrichment column ArC. The LP argon-enriched stream 138 can be fed to a lower portion of the argon enrichment column ArC (e.g. at a bottom of the column or adjacent a bottom of the column). LP argon-enriched stream 138 can ascend within the argon enrichment column ArC to exit the top of the column or exit adjacent the top of the column as an argon-rich vapor stream 142. The argon-rich vapor stream can have a concentration of argon that is higher than the concentration of argon within the LP argon-enriched stream 138 fed to the argon enrichment column ArC. For instance, the argon-rich vapor stream 142 can include 100 vol % to 95 vol % argon (e.g. the argon-rich vapor stream 142 can include 0 vol % to 4 vol % oxygen, 0 vol % to 1 vol % nitrogen, and the balance argon).

The argon-rich vapor stream 142 can be output from the argon enrichment column ArC and fed to a second reboiler-condenser 143 via an argon vapor reboiler-condenser feed conduit positioned between the argon enrichment column ArC and the second reboiler-condenser 143. The second reboiler-condenser 143 can substantially condense the argon-rich vapor of the argon-rich vapor stream 142 to a liquid (e.g. condense an entirety of the argon-rich vapor to a liquid or condense at least 90% of the vapor to a liquid, condense at least 95% of the vapor to a liquid, condense enough of the argon-rich vapor so that it acts as a liquid or the condensed stream output from the second reboiler-condenser has the properties of a liquid, etc.). The substantially condensed or entirely condensed argon-rich stream 144 output from the second reboiler-condenser 143 can be fed to a phase separator PS that can output an argon vapor product stream 148 that includes argon (Ar) at high concentrations (e.g. 100 vol % Ar to 95 vol % Ar, between 100 vol % Ar and 99 vol % Ar, etc.). A liquid argon reflux stream 146 can be output from the phase separator PS and fed back to the argon enrichment column ArC.

The liquid argon reflux stream 146 can be output from the separator PS or as a fluid portion of argon-rich fluid stream 144 for feeding as reflux to the argon enrichment column ArC via an argon enrichment column reflux conduit connected between the argon enrichment column ArC and the phase separator PS. The argon enrichment column ArC can receive the liquid argon reflux stream 146 adjacent an upper portion of the argon enrichment column ArC (e.g. at its top or near its top) so that the liquid argon reflux is passed downwardly through the argon enrichment column ArC in counter-current flow with the uprising argon vapor of the argon-enriched stream 138 fed to the argon enrichment column ArC.

In some embodiments, the condensed argon-rich fluid of the argon-rich vapor stream 142 fed to the second reboiler-condenser 143 can be output from the second reboiler-condenser 143 as an argon-rich fluid stream 144 which is entirely liquid. In such a case a phase separator PS in not necessary and the argon product stream 148 can be split off from argon-rich fluid stream 144 and the remaining flow of the argon-rich fluid stream 144 not split off to form the product stream can be used as the liquid argon reflux stream 146.

The argon enrichment column ArC can also output an argon depleted fluid stream 140 for feeding to the second column 137 via an argon depleted fluid feed conduit connected between the second column 137 and the argon enrichment column ArC. The argon depleted fluid stream 140 can be output at a lower portion of the argon enrichment column ArC (e.g. at its bottom or adjacent its bottom) for feeding to a location that is below the location at which the LP argon-enriched stream 138 is output from the second column 137 or can be located at a position at or near the position at which the LP argon-enriched stream 138 is output from the second column 137.

The argon enrichment column ArC can also utilize a reboiler 131 (e.g. have the reboiler 131 positioned adjacent the column and/or within the column, etc.). The reboiler 131 can be included within a lower portion (e.g. a bottom) of the argon enrichment column ArC as shown in FIG. 1, for example. This reboiler would be referred to as an internal reboiler. Alternatively reboiler 131 can be physically located outside the argon enrichment column ArC and connected to the argon enrichment column ArC so that the reboiler 131 can receive a liquid feed from the argon enrichment column ArC and return a partially boiled stream back to the argon enrichment column ArC. This reboiler would be referred to as an external reboiler. The thermodynamic effect of these two reboilers is the same.

Figure 2:
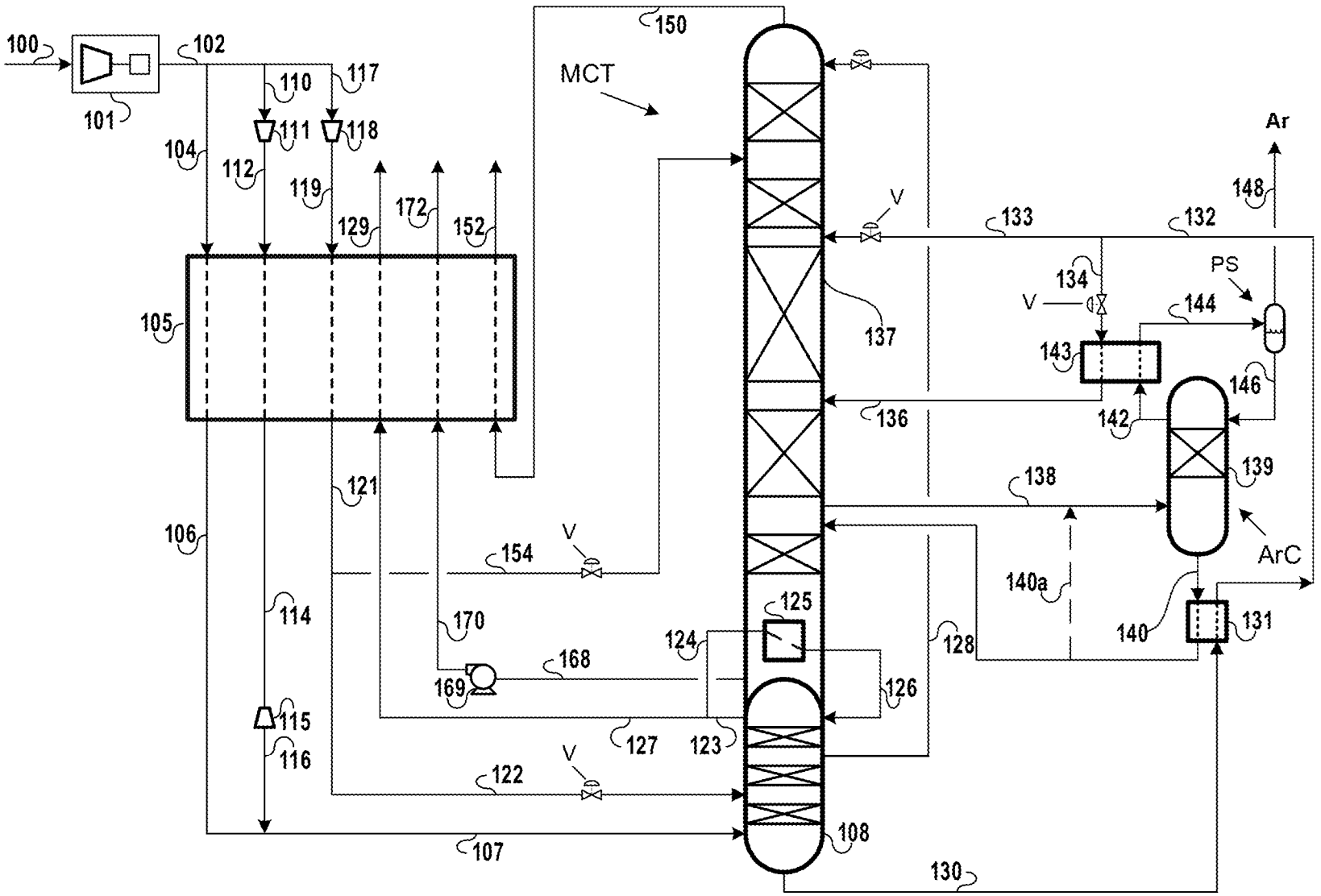

The reboiler 131 can be positioned adjacent the argon enrichment column ArC by being positioned for subcooling the HP oxygen-enriched stream 130 while warming the argon depleted fluid stream 140 after the argon depleted fluid stream 140 is output from the argon enrichment column ArC and before it is fed to the second column 137 as shown in FIG. 2. Alternatively, the argon depleted fluid stream 140 output from the reboiler 131 can be recycled directly to the argon enrichment column ArC by being fed to the LP argon-enriched stream 138 for mixing therewith before that stream is fed to the argon enrichment column ArC as shown in broken line 140*a* in FIG. 2. As yet another alternative, the argon depleted fluid stream 140 output from the reboiler 131 can be recycled more directly to the argon enrichment column ArC by being fed directly back to the argon enrichment column ArC via a heated argon depleted fluid stream recycle conduit connected between the reboiler 131 and the argon enrichment column ArC.

Figure 3:
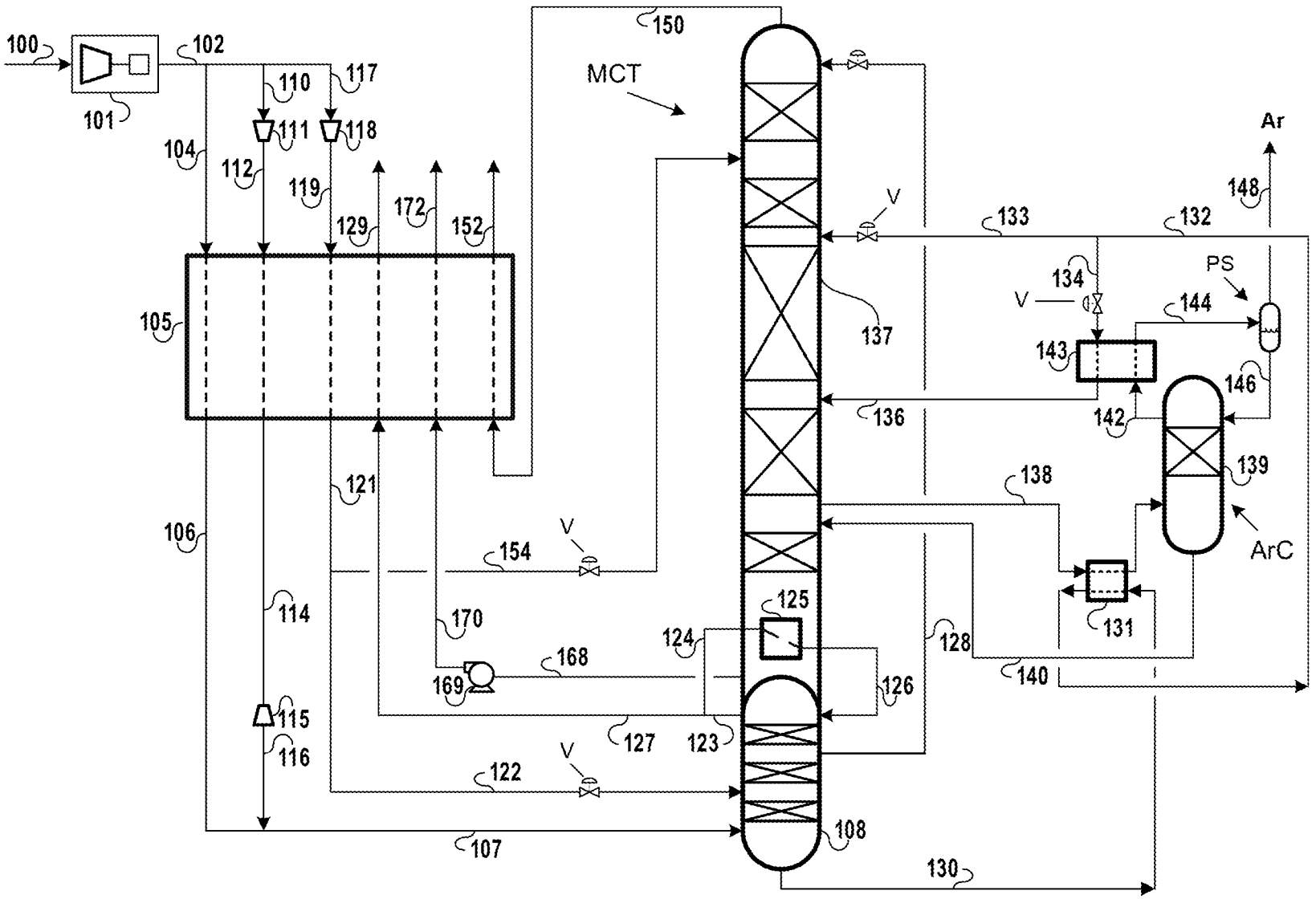

As yet another option, the reboiler 131 can alternatively be positioned adjacent the argon enrichment column ArC by being positioned for subcooling the HP oxygen-enriched stream 130 while heating the LP argon-enriched stream 138 before the LP argon-enriched stream 138 is fed to the argon enrichment column ArC as shown in FIG. 3.

In the embodiments of FIGS. 2 and 3, the reboiler 131 can be configured as a heat exchanger configured for cooling the HP oxygen-enriched stream 130 output from the first column 108 while also warming the LP argon-enriched stream 138 or the argon depleted fluid stream 140 for vaporizing some of that stream and/or increasing the temperature of that stream. Such warming and cooling can be provided via a heat exchanger, or heat transfer between the streams received by the reboiler 131.

Figure 4:
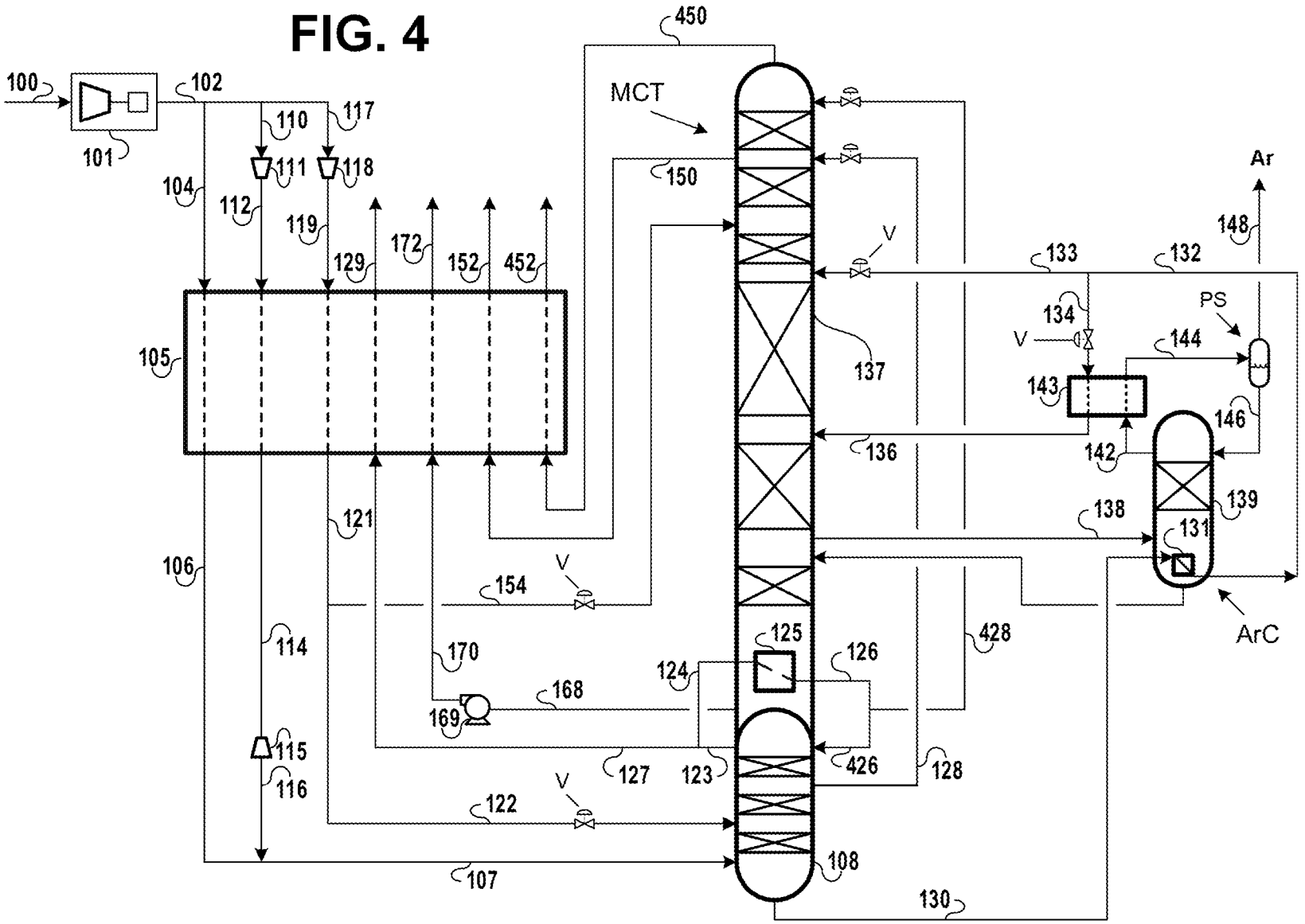

In the embodiments discussed above concerning FIGS. 1-3, the plant 1 can be configured to produce a HP nitrogen-rich vapor stream 123 which can be fed to the first heat exchanger 105 and output from the first heat exchanger as a first HP nitrogen-rich vapor product stream 129. The plant 1 can also produce an LP nitrogen-enriched stream 150 which can be fed to the first heat exchanger 105 and output from the first heat exchanger as a nitrogen-rich or nitrogen-enriched product stream. An additional nitrogen-rich product stream may also be recovered from the second column 137 as stream 450, an example of which is shown in FIG. 4. It should be appreciated that the embodiment of FIG. 4 is a modification of the embodiment of FIG. 1. The utilization of this additional nitrogen-rich product stream 450 (an example of which is shown in FIG. 4) can be utilized in other embodiments as well (e.g. embodiments of FIGS. 2 and 3, etc.).

As can be appreciated from FIG. 4, the HP condensate stream 126 can be split so a first portion is used as reflux for the first column 108 and a second portion is used as a pure reflux stream 428 for the second column 137. The second LP nitrogen-enriched stream 450 can be output from the second column 137 and fed to the first heat exchanger 105 for cooling therein to form a pure product nitrogen stream 452 (or a substantially pure product nitrogen stream 452). The second LP nitrogen-enriched stream 450 can be a nitrogen-enriched vapor stream that includes nitrogen in a concentration range of 95 vol % to essentially 100 vol % (e.g. having a de minimis level of impurities) or can include nitrogen in a concentration range of 95 vol % to less than or equal to 100 vol % in some embodiments. In this embodiment of FIG. 4, the LP nitrogen-enriched stream 150 output from the LP column 137 can be considered a first LP nitrogen-enriched stream that can be emitted as waste gas to atmosphere or used in another plant unit (e.g. used as a product gas, regeneration gas, fed to another plant unit or other use, etc.).

Similar modifications as discussed above can be made to the embodiments of FIGS. 2 and 3, as well. In such additional embodiments, the LP nitrogen-enriched stream 150 output from the LP column can be considered a first LP nitrogen-enriched stream and the LP column can also emit the second LP nitrogen-enriched stream 450 for being heated in the heat exchanger 105 for outputting the product nitrogen stream 452. The HP condensate stream 126 can be split for such embodiments as well similar to the above discussed embodiment of FIG. 4 (e.g. the HP condensate stream 126 can be split so a first portion is used as reflux for the first column 108 and a second portion is used as a pure reflux stream 428 for the second column 137).

In the embodiment of FIG. 1, the reboiler 131 can be considered a reboiler or a heat exchanger within the argon enrichment column ArC that is positioned and configured to cool the HP oxygen-enriched stream 130 output from the first column 108 within the argon enrichment column ArC and also generates vapor from the liquid descending to the bottom of the ArC.

After the HP oxygen-enriched stream 130 is cooled via the reboiler 131, the HP oxygen-enriched stream 130 can be routed as a subcooled HP oxygen-enriched stream 132. The subcooled HP oxygen-enriched stream 132 can be split into a first oxygen-enriched feed stream 133 and a second-reboiler-condenser oxygen-enriched feed stream 134. The first oxygen-enriched feed stream 133 can undergo a pressure reduction via a pressure reduction mechanism (e.g. a valve, other type of suitable mechanism, etc.) prior to being fed to the second column 137. The second reboiler-condenser oxygen-enriched feed stream 134 can be fed to the second reboiler-condenser 143 for being warmed therein to a vapor or at least a partially vaporized fluid and provide the cooling medium for condensation of the argon-rich vapor stream 142 fed therein. The second-reboiler-condenser oxygen-enriched feed stream 134 can be output from the second-reboiler-condenser 143 as a second oxygen-enriched feed stream 136 for feeding to the second column 137. The second oxygen-enriched feed stream 136 can undergo a pressure reduction to a suitable pressure for feeding to the second column 137 prior to the stream being fed to the second column 137 as well (e.g. via a pressure reduction mechanism such as a valve or other type of suitable mechanism).

The second oxygen-enriched feed stream 136 can be fed to the second column 137 at a location that is below the location at which the first oxygen-enriched feed stream 133 is fed to the second column 137. In other embodiments, the two feed streams can be mixed together (not shown) prior to being fed to the second column 137.

It should be appreciated that these various streams 133 and 134 can each be considered different portions of the HP oxygen-enriched stream 130 that is split to form those streams. Each stream can be considered a first portion or a second portion of the HP oxygen-enriched stream 130, for example.

It should also be appreciated that the HP oxygen-enriched stream 132 can be further cooled by heating other gas and or liquid streams before being utilized in the reboiler-condenser 143, such as heating liquid at the bottom of another argon column to further purify argon product stream 148.

It should also be understood that the first HP nitrogen-enriched LP feed stream 128 as well as the first oxygen-enriched feed stream 133 and the second oxygen-enriched feed stream 136 can all be fed to the second column 137 in some operational cycles or some embodiments. When all such flows are fed to the second column 137, the first HP nitrogen-enriched LP feed stream 128 can be considered a second column reflux stream. Alternatively, in such situations, the first oxygen-enriched feed stream 133 can be considered a third oxygen-enriched LP feed stream and the second oxygen-enriched feed stream 136 can be considered a second oxygen-enriched LP feed stream.

The above discussed embodiments of FIGS. 1-4 can utilize a multiple column process that includes the first column 108 configured as an HP column, a second column 137 configured as an LP column, and a third column 139 configured as an argon enrichment column ArC. The argon recovery benefits of utilization of the reboiler 131 within the argon enrichment column ArC or adjacent the argon enrichment column ArC to cool the HP oxygen-enriched stream 130 prior to that stream being at least partially fed to the second reboiler-condenser 143 of the argon enrichment column ArC can also be obtained without the splitting of the HP oxygen-enriched stream 130. For example, in some implementations or in some operational cycles, the HP oxygen-enriched stream 130 may not be split and instead, the entirety of this stream may be fed to the second reboiler-condenser 143. In such embodiments or operational cycles, the second-reboiler-condenser oxygen-enriched feed stream 134 can include an entirety of the HP oxygen-enriched stream 132 output from the reboiler 131 and the second oxygen-enriched feed stream 136 output from the second reboiler-condenser can be considered a first oxygen-enriched feed stream that is fed to the second column 137 since stream 133 will not be formed for such implementations or operational cycles.

In some implementations, valves V can be provided for the conduits through which the second-reboiler-condenser oxygen-enriched feed stream 134 passes to the second reboiler-condenser 143 and through which the first oxygen-enriched feed stream 133 can pass for being fed to the second column 137. The valves can be adjusted between open and closed positions to adjust how the subcooled HP oxygen-enriched stream 132 output from the reboiler 131 can be split (e.g. proportion of subcooled HP oxygen-enriched stream 132 passed to each stream and/or adjustment of valves V to avoid formation of the first oxygen-enriched feed stream 133 and have the entirety of the subcooled HP oxygen-enriched stream 132 fed to the second reboiler-condenser 143 as the second-reboiler-condenser oxygen-enriched feed stream 134). The valves V can also (or alternatively) be included in these conduits to provide pressure reduction for these streams.

It should be appreciated that the plant 1 can be configured to utilize an air separation process that can be configured to facilitate recovery of at least one argon fluid. The air separation process can also provide for recovering at least one nitrogen fluid flow as well as at least one argon fluid flow. The air separation process can also provide for recovering at least one oxygen fluid flow as well as at least one argon fluid flow. Embodiments can also recover at least three fluids (e.g. at least one oxygen fluid flow, at least one nitrogen fluid flow, and at least one argon fluid flow) as well.

Figure 5:
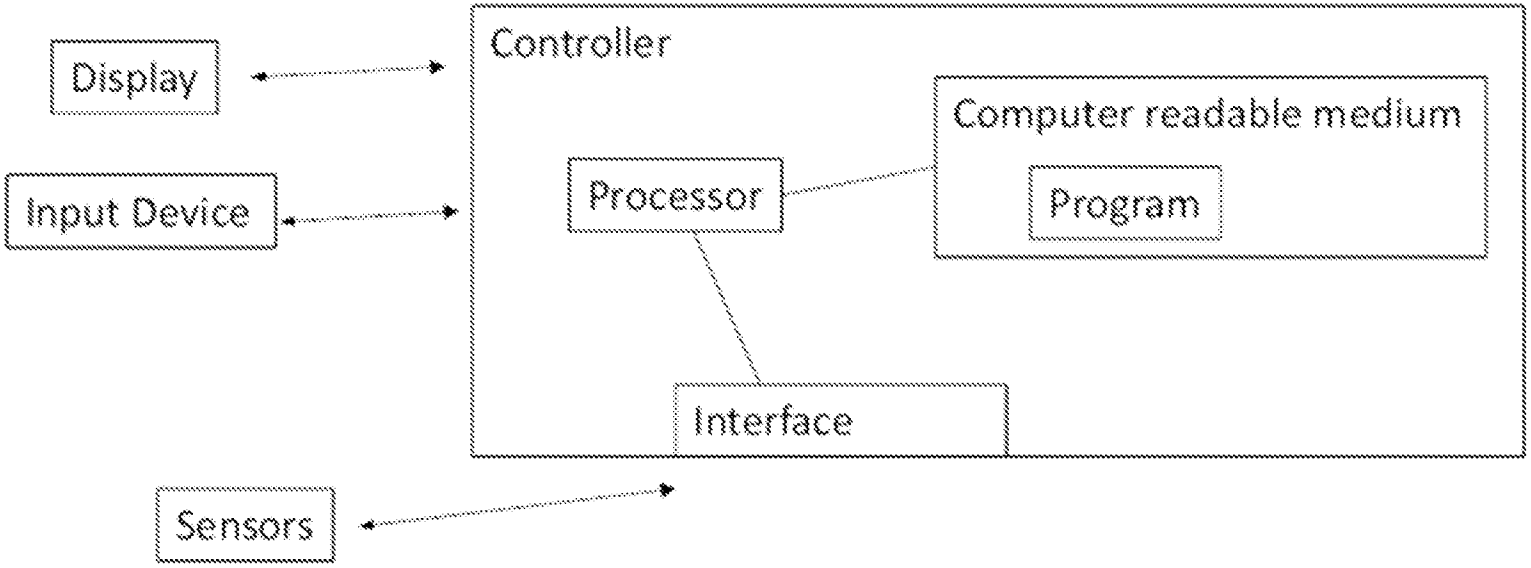

Embodiments of the plant can utilize a controller, such as the exemplary controller shown in FIG. 5, to help monitor and/or control operations of the plant. The plant can be configured as an air separation system or a cryogenic air separation system that is configured as a standalone facility or is incorporated in a larger facility having other plant facilities (e.g. a manufacturing plant for making semiconductor chips, an industrial plant for making goods, a mineral refining facility, etc.).

It should be appreciated that embodiments of the plant including the embodiments of FIGS. 1-4 can be configured as an air separation plant or other type of plant in which it is desired to recover (a) only argon from a feed gas, (b)

nitrogen and argon from a feed gas, (c) oxygen and argon from a feed gas, (d) nitrogen, argon, and oxygen from a feed gas, or (e), nitrogen, argon, oxygen, as well as krypton xenon, and/or neon from a feed gas (e.g. air, waste emissions from a plant, etc.).

It should be understood that some embodiments (e.g. embodiment of FIG. 1) can utilize a reboiler 131 positioned near or at the bottom of argon enrichment column ArC to increase boil-up therein and simultaneously provide added cooling duty to drive a condenser of the second reboiler-condenser 143 of the argon enrichment column ArC to provide improved argon recovery.

In other embodiments (e.g. embodiment of FIG. 2), the reboiler 131 can be provided and positioned to vaporize a portion of the argon depleted fluid stream 140 before it is returned to the second column 137. This recycled vapor may then ultimately be added into the flow of LP argon-enriched stream 138. This arrangement can permit the reboiler 131 to provide the same additional boilup for the argon enrichment column ArC as may be provided in other embodiments (e.g. FIG. 1). Similarly, the reboiler's output of the subcooled HP oxygen-enriched stream 132 simultaneously provides added cooling duty to drive the condenser of the second reboiler-condenser 143 (as in FIG. 1).

In yet other embodiments (e.g. the embodiment of FIG. 3), the reboiler 131 can be positioned and arranged to increase the temperature of the LP argon-enriched stream 138 before that flow is fed to the argon enrichment column ArC. That additional heat added to this stream can cause the liquid it contacts with in the packing of the argon enrichment column ArC to partially vaporize. This can provide the same type of improved added boilup for the argon enrichment column ArC that can be obtained in other arrangements (e.g. the embodiment of FIG. 2). Also, the reboiler's output of the subcooled HP oxygen-enriched stream 132 can simultaneously provide added cooling duty to drive the condenser of the second reboiler-condenser 143 (as in FIGS. 1 and 2).

As can be appreciated from the discussion of exemplary embodiments discussed herein, different embodiments can be arranged and configured so that there is an increased boilup and reflux provided for the argon enrichment column ArC. This increase in boilup and reflux can be proportional such that the increase in boilup is equal to the increase in reflux that can be provided. The increasing of the boilup and reflux by equal amounts can have the effect of increasing product purity and/or permit an increase in a flow rate of obtained product having the same purity (which in either case provides an improvement in recovery).

The plant can be configured to include process control elements positioned and configured to monitor and control operations (e.g. temperature and pressure sensors, flow sensors, an automated process control system having at least one work station that includes a processor, non-transitory memory and at least one transceiver for communications with the sensor elements, valves, and controllers for providing a user interface for an automated process control system that may be run at the work station and/or another computer device of the plant, etc.).

An example of such a process control system that may be included is shown in FIG. 4, for example. The process control system can include a controller having a processor that is connected to a computer readable medium and at least one interface. The computer readable medium can have a program stored thereon that defines a process control method implemented by the controller when the processor runs the program. The controller can receive data from sensors (e.g. temperature sensors, flow sensors, pressure sensors, etc.) and utilize that data when implementing the method defined by the program. The controller can be communicatively connected to at least one input device and at least one output device as well. The at least one input device can be, for example, a workstation, a keyboard, a pointer device, or other type of input device. The output device can include a touch screen, a screen, a monitor, a printer, or other type of output device.

EXAMPLE

Fundamental simulations were carried out to evaluate the utility of different embodiments of the invention and try and ascertain the type of improvements that could be provided by implementation of the embodiments. Table 1 provides a summary of argon recovery, as well as selected material balance flows, and compositions for a simulated implementation of the embodiment of FIG. 1, which produced zero low pressure high purity gaseous nitrogen delivery product. Table 1 also provides simulation results from a comparable conventional process used to provide an evaluation of how the simulated implementation of an embodiment of FIG. 1 would perform as compared to a comparable conventional process.

TABLE 1

Simulation Parameters and Results From Conducted Evaluation

| Parameters | Conventional Process | Simulated Implementation of Embodiment Of Figure 1 |
|---|---|---|
| Inlet dry air flow ($Nm^3/hr$) | 518931 | 518916 |
| Oxygen recovery (mole/100) | 19.27 | 19.27 |
| Nitrogen recovery (mole/100) | 19.3 | 19.3 |
| Argon recovery (%) | 67.9 | 70.6 |
| Liquid Argon (mTPD) | 139.1 | 144.8 |
| Condenser duty (kW) | −8385.88 | −8836.84 |
| Reboiler duty (kW) | 0 | 627.302 |

The conventional process does not utilize a reboiler 131. This is why the conventional process does not have any reboiler duty (e.g. a reboiler duty of 0 kW).

The information in Table 1 demonstrates that compared to the conventional process, the implementation of the embodiment of FIG. 1 can deliver significantly higher argon recovery (about a 4% increase in performance in argon recovery by increasing recovery by 2.7% points).

Further, the simulation results showing that both the condenser and reboiler duties changed significantly (reboiler duty was 627.302 kW as compared to 0 kW and the condenser duty changes from −8385.88 kW to −8836.84 kW) demonstrated that the boilup and reflux have increased, with the result being higher argon recovery.

In this conducted simulation, the increased condenser duty that was found to be provided by use of the reboiler 131 for this simulated experiment is almost fully reflected by the improvement in condenser duty that can be obtained. The simulation work that was performed confirmed our belief that embodiments can provide a significant improvement in argon recovery that can permit more flexible operation that can also provide more efficient processing.

We also ran a simulation that tried matching the base case argon recovery of a prior art process. This resulted in the simulation for an exemplary embodiment including an implementation of reboiler 131 and reducing a number of stages in at least one column to permit a matching of argon recovery to try and determine how an exemplary use of the reboiler 131 may permit other types of improvements in operational efficiency. In that simulation, we found that six stages from a column could be removed to get the same recovery of argon. The reduction in stages that can be provided can improve operational efficiency as well as reduce capital and operational costs.

It should be appreciated that embodiments can be provided without any increase in power to obtain the increased argon recovery. For instance, the reboiler and condenser duties can be provided by heat pumping and the heat pumping can be provided with or without a power impact. If there is a power impact it can appear as higher feed pressure or more feed flow, or lower product delivery pressure. In those situations, however, the supposed power impact can be negligible or insignificant in view of the improved argon recovery that is obtained. For example, the increase in a condenser duty can be essentially (if not exactly) offset by an increase in reboiler duty of the reboiler 131.

Moreover, embodiments can be provided for retrofitting a pre-existing air separation unit. For instance, a retrofitting method can include providing a reboiler 131 for positioned in an argon enrichment column ArC or adjacent an argon enrichment column ArC. Conduits can be rearranged or adjusted as may be needed to accommodate the use of the new reboiler 131. The reboiler 131 can be positioned in the argon enrichment column ArC as shown in FIG. 1 during the retrofit operation. Alternatively, the reboiler 131 can be retrofit into a pre-existing facility so the reboiler 131 is positioned for subcooling an HP oxygen-enriched stream 130 output from an HP column while heating an LP argon-enriched stream 138 output from an LP column via heat transfer between these streams before the LP argon-enriched stream 138 is fed to the argon enrichment column ArC as shown in FIG. 3. As yet another option, the retrofit operation can be performed so that the reboiler 131 is positioned for subcooling an HP oxygen-enriched stream 130 output from an HP column while warming the argon depleted fluid stream 140 after the argon depleted fluid stream 140 is output from an argon enrichment column ArC via heat transfer between these streams and before the argon depleted fluid stream 140 is fed to an LP column 137 as shown in FIG. 2 and/or can be recycled directly back to the steam 138 for feeding back to the argon enrichment column ArC as shown via broken line 140*a* in FIG. 2.

Embodiments of the retrofitting can also include providing updated process control elements, an updated automated process control program, or other products or services for installation of the reboiler 131 and subsequent use of an embodiment of our air separation process that can include use of the reboiler 131 as discussed herein.

It should be appreciated that modifications to the embodiments explicitly shown and discussed herein can be made to meet a particular set of design objectives or a particular set of design criteria. For instance, the arrangement of valves, piping, and other conduit elements (e.g. conduit connection mechanisms, tubing, seals, etc.) for interconnecting different units of the plant for fluid communication of the flows of fluid between different units can be arranged to meet a particular plant layout design that accounts for available area of the plant, sized equipment of the plant, and other design considerations. For instance, the size of each column, number of stages each column has, the size and arrangement of each reboiler-condenser, and the size and configuration of any heat exchanger, conduits, expanders, pumps, or compressors can be modified to meet a particular set of design criteria. As another example, the flow rate, pressure, and temperature of the fluid passed through one or more heat exchangers as well as passed through other plant elements can vary to account for different plant design configurations and other design criteria. As yet another example, the number of plant units and how they are arranged can be adjusted to meet a particular set of design criteria. As yet another example, the material composition for the different structural components of the units of the plant and the plant can be any type of suitable materials as may be needed to meet a particular set of design criteria.

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of the processes utilized to recover fluids (e.g. argon, argon and nitrogen, argon and oxygen, etc.) from air, gas separation plants configured to recover at least argon from at least one feed gas, air separation plants, air separation systems, systems utilizing multiple columns to recover nitrogen and argon, plants utilizing such systems or processes, and methods of making and using the same have been shown and described above, it is to be distinctly understood that the invention is not limited thereto but may be otherwise variously embodied and practiced within the scope of the following claims.

What is claimed is:

1. A process for separation of a feed gas comprising oxygen, nitrogen, and argon, the process comprising:

compressing a feed gas via a compression system of a separation system having a first column and a second column, the first column being a high pressure (HP) column operating at a pressure that is higher than the second column, the second column being a low pressure (LP) column operating at a pressure that is lower than the first column;

feeding the compressed feed gas to a first heat exchanger to cool the compressed feed gas;

feeding at least a first portion of the compressed and cooled feed gas to the HP column to produce an HP oxygen-enriched stream;

passing the HP oxygen-enriched stream output from the HP column through a reboiler positioned between the HP column and an argon enrichment column;

passing an argon depleted fluid stream output from the argon enrichment column to the reboiler so that the HP oxygen-enriched stream is cooled via heat transfer with the argon depleted fluid stream or passing an LP argon-enriched stream output from the LP column to the reboiler so that the HP oxygen-enriched stream is cooled via heat transfer with the LP argon-enriched stream;

the reboiler outputting the HP oxygen-enriched stream after the HP oxygen-enriched stream is cooled; and passing at least a portion of the HP oxygen-enriched stream output from the reboiler to a reboiler-condenser of the argon enrichment column for condensing at least a portion of an argon-enriched vapor output from the argon enrichment column that is fed to the reboiler-condenser.

2. The process of claim 1, wherein the reboiler is positioned in a bottom of the argon enrichment column or within the argon enrichment column.

3. The process of claim 1, wherein the passing of at least a portion of the HP oxygen-enriched stream output from the reboiler to the reboiler-condenser of the argon enrichment column for condensing at least a portion of the argon-enriched vapor output from the argon enrichment column that is fed to the reboiler-condenser comprises:

splitting the HP oxygen-enriched stream output from the reboiler to form a first oxygen-enriched stream to feed to the LP column and a second oxygen-enriched stream to feed to the reboiler-condenser of the argon enrichment column.

4. The process of claim 1, wherein the passing of at least a portion of the HP oxygen-enriched stream output from the reboiler to the reboiler-condenser of the argon enrichment column for condensing at least a portion of the argon-enriched vapor output from the argon enrichment column that is fed to the reboiler-condenser comprises:

passing an entirety of the HP oxygen-enriched stream output from the reboiler to the reboiler-condenser of the argon enrichment column.

5. The process of claim 1, comprising:

the HP column outputting a second column reflux stream to feed the second column reflux stream to the LP column.

6. The method of claim 1, wherein the passing of the argon depleted fluid stream output from the argon enrichment column to the reboiler so that the HP oxygen-enriched stream is cooled via heat transfer with the argon depleted fluid stream is performed.

7. The method of claim 1, wherein the passing of the LP argon-enriched stream output from the LP column to the reboiler so that the HP oxygen-enriched stream is cooled via heat transfer with the LP argon-enriched stream is performed.

8. A separation system comprising:

a first column and a second column, the first column being a high pressure (HP) column operating at a pressure that is higher than the second column, the second column being a low pressure (LP) column operating at a pressure that is lower than the first column, the HP column being connected to the LP column;

an argon enrichment column;

a reboiler;

the HP column connected to the reboiler so that an HP oxygen-enriched stream output from the HP column is feedable to the reboiler for cooling of the HP oxygen-enriched stream;

the reboiler positioned to receive an argon depleted fluid stream output from the argon enrichment column so that the HP oxygen-enriched stream is coolable via heat transfer with the argon depleted fluid stream; and the reboiler connected to a reboiler-condenser of the argon enrichment column so that at least a portion of the HP oxygen-enriched stream is feedable to the reboiler-condenser for condensing at least a portion of an argon-enriched vapor output from the argon enrichment column that is feedable to the reboiler-condenser.

9. The separation system of claim 8, wherein the reboiler is positioned in a bottom of the argon enrichment column.

10. The separation system of claim 8, wherein the HP column is connected to the LP column such that a second column reflux stream outputtable from the HP column is feedable to the second column reflux stream to the LP column.

11. The separation system of claim 8, wherein the reboiler is connected to the reboiler-condenser of the argon enrichment column and the LP column such that the HP oxygen-enriched stream outputtable from the reboiler is splittable into a first oxygen-enriched stream to feed to the LP column and a second oxygen-enriched stream to feed to the reboiler-condenser of the argon enrichment column.

12. The separation system of claim 8, wherein the reboiler is connected to the reboiler-condenser of the argon enrichment column such than an entirety of the HP oxygen-enriched stream outputtable from the reboiler is feedable to the reboiler-condenser of the argon enrichment column.

13. A method of retrofitting an air separation unit, comprising:

positioning a reboiler between a high pressure (HP) column and an argon enrichment column so that an HP oxygen-enriched stream output from an HP column is feedable to the reboiler to cool the HP oxygen-enriched stream and (i) so that an argon depleted fluid stream output from the argon enrichment column is feedable to the reboiler so that the HP oxygen-enriched stream feedable to the reboiler is coolable via heat transfer with the argon depleted fluid stream or (ii) so that a low pressure (LP) argon-enriched stream output from a second column is feedable to the reboiler so that the HP oxygen-enriched stream is coolable via heat transfer with the LP argon-enriched stream;

connecting the reboiler to a reboiler-condenser of the argon enrichment column so that at least a portion of the HP oxygen enriched stream output from the reboiler is feedable to the reboiler-condenser for condensing at least a portion of an argon-enriched vapor outputtable from the argon enrichment column that is feedable to the reboiler-condenser.

14. The method of claim 13, wherein the reboiler is positioned in a bottom of the argon enrichment column or within a lower portion of the argon enrichment column.

15. The method of claim 13, wherein the positioning of the reboiler includes adjusting conduits to accommodate use of the reboiler.

16. The method of claim 13, wherein the reboiler is positioned so that the argon depleted fluid stream output from the argon enrichment column is feedable to the reboiler so that the HP oxygen-enriched stream feedable to the reboiler is coolable via heat transfer with the argon depleted fluid stream.

17. The method of claim 13, wherein the reboiler is positioned so that the LP argon-enriched stream output from the second column is feedable to the reboiler so that the HP oxygen-enriched stream is coolable via heat transfer with the LP argon-enriched stream.

* * * * *